US007533553B2

(12) United States Patent
Knaup et al.

(10) Patent No.: US 7,533,553 B2
(45) Date of Patent: May 19, 2009

(54) HOT-SHAPING AND HARDENING A WORKPIECE

(75) Inventors: Hans-Jürgen Knaup, Bad Lippspringe (DE); Christian Hielscher, Delbrück (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 134 days.

(21) Appl. No.: 11/452,303

(22) Filed: Jun. 13, 2006

(65) Prior Publication Data

US 2006/0283530 A1 Dec. 21, 2006

(30) Foreign Application Priority Data

Jun. 16, 2005 (DE) ..... 10 2005 028 010

(51) Int. Cl.
*B21D 37/16* (2006.01)

(52) U.S. Cl. ..... 72/342.1; 72/342.2; 72/342.5

(58) Field of Classification Search ..... 72/342.1, 72/342.2, 342.5, 364; 148/645–647
See application file for complete search history.

(56) References Cited

U.S. PATENT DOCUMENTS 1,457,772 A * 6/1923 Forsyth ..... 148/647
2,821,016 A * 1/1958 Dickson ..... 29/424
6,048,418 A 4/2000 Canner ..... 148/589
6,267,828 B1 * 7/2001 Kushida et al. ..... 148/334

FOREIGN PATENT DOCUMENTS

| | | |
|---|---|---|
| DE | 26 03 618 | 12/1976 |
| EP | 1 191 111 | 3/2002 |
| GB | 1 490 535 | 11/1977 |
| JP | 55131122 | 10/1980 |

* cited by examiner

*Primary Examiner*—Dana Ross
*Assistant Examiner*—Teresa Bonk
(74) *Attorney, Agent, or Firm*—Andrew Wilford

(57) ABSTRACT

A method of hot-shaping and hardening a hot steel workpiece that is at or above its AC3 temperature. The method has the steps of positioning the hot workpiece between confronting faces of a lower die and an upper die, providing a coolant bath having a liquid level above at least a portion of the face of the lower die, and pressing the hot workpiece with the upper die down against the lower die so as to both deform the workpiece so that it conforms to the shapes of the faces and that it is at least partially immersed in the bath,

6 Claims, 3 Drawing Sheets

HOT-SHAPING AND HARDENING A WORKPIECE

FIELD OF THE INVENTION

The present invention relates to the hot-shaping and hardening of a steel workpiece. More particularly this invention concerns a method and apparatus for substantially simultaneously hot-shaping and hardening a steel plate.

BACKGROUND OF THE INVENTION

A method is described in GB 1,490,535 whereby a press serves to form and harden a relatively thin steel plate with good dimensional stability. The steel plate is heated to a temperature above its AC3 point and is then pressed in less than 5 seconds into the final shape between two indirectly cooled dies under substantial shape change and is subjected to a rapid cooling while remaining in the press, so that a martensitic and/or bainitic fine grain structure is achieved. A hot-shaped part produced this way is used in motor-vehicle construction for example for structural and safety parts such as bumpers and B columns.

Currently commercial hydraulic presses are used for hot shaping and press hardening, and are modified and adjusted for this special task. As described in above-cited GB 1,490,535 these dies are cooled indirectly. For this purpose cooling passages are set about 5 mm under the die surface alongside the die inner side with the given component contour. A liquid coolant, typically water, is pumped through these cooling passages to transfer to the outside heat passed from the hot component to the die. The cooling passages are formed in the die by drilling. Thus, the placement of the drills can be carried out only in sections, especially with a nonlinear shape, as the drilled holes must be straight. With a curved and/or complex component shape the die is hence separated into many single segments in which cooling passages are placed in sections and that then has to be connected with the other sections through a further passage or has to open to the outside, Consequently, the production of such indirectly cooled dies is laborious and expensive. In addition, leaks caused by tension cracks occur in the die during operation, so that cooling liquid leaks from the cooling passages and evaporates. Hence, the dies have to be repaired continuously, creating always down times in production arise.

A method is described in EP 1 191 111 of Gustavsson whereby a flat metal component is hardened by first heating it, and then conveying it along a conveying path to a position between an upper and a lower die of a press. Then the two parts are pressed together to deform the part and at the same time these parts are cooled. The cooling can be done by actually lowering the parts into a bath of the cooling liquid while they grip the deformed workpiece. Here the workpiece, however, is deformed in advance and not in the press that basically serves as a holder for maintaining workpiece shape during tempering.

In DE 26 03 618 of Kenebuc, a method and apparatus are described for heat treatment of steel where a press is used having shaped dies in whose faces concentric annular grooves are formed. Coolant passages extend through the dies at a spacing from their working faces. A cooling liquid is fed through these passages to up to the annular grooves for direct contact with a clamped workpiece to be hardened. In this manner a continuous hardening is guaranteed. This method is relatively slow and uses dies that are very complicated and hard to maintain.

OBJECTS OF THE INVENTION

It is therefore an object of the present invention to provide an improved system for hot-shaping and hardening a workpiece, Another object is the provision of such an improved system for hot-shaping and hardening a workpiece that overcomes the above-given disadvantages, in particular that is fast and that uses relatively simple equipment.

SUMMARY OF THE INVENTION

A method of hot-shaping and hardening a hot steel workpiece that is at or above its AC3 temperature. The method has according to the invention the steps of positioning the hot workpiece between confronting faces of a lower die and an upper die, providing a coolant bath having a liquid level above at least a portion of the face of the lower die, and pressing the hot workpiece with the upper die down against the lower die so as to both deform the workpiece so that it conforms to the shapes of the faces and that it is at least partially immersed in the bath.

In other words, the lower die is at least partially immersed in a liquid-coolant bath. The workpiece heated above AC3 is placed above the liquid level into the press. The workpiece can be a plate as well as a preshaped component. The upper die then moves in direction of the lower die and thereby dips the workpiece into the liquid bath. In the liquid bath is a cooling liquid for quenching of the workpiece. Contact with the liquid immediately starts the hardening process that is completed when the workpiece has reached its final shape according to the contours of the faces of the dies. Consequently, both a shaping and a hardening of the workpiece takes place as the upper die is advanced against the lower die.

Up to now the workpiece to be hardened had to remain for a certain holding time in the closed press, until the desired martensitic structure and the required component strength were reached. The method according to invention reduces the necessary holding times so much that production of the components suitable for this method is possible in a rapid-fire automatic system with relatively fast cycling of a mechanical press. With the first contact of the upper die against the workpiece the hardening process is initiated. The workpiece is immersed with an increasing shape change into the liquid, and simultaneously the hardening process rapidly accelerates. The shape change resistance of the component is still small enough to deep draw it between the two die halves according to the die-face shape. In the ideal case the hardening is completed simultaneously with the deep drawing operation, so that the press can immediately open again when it reaches bottom dead center.

The gradient of cooling, i.e. the cooling rate of the workpiece, can be adjusted through the properties of the liquid, the deformation rate and especially also through the position of the liquid level. If the workpiece passes a shorter distance through the liquid or if it passes through the liquid faster, higher deformation levels can be attained. Which workpieces can be deep drawn and hardened with the method according to invention depends on both the geometry of the workpiece and also the workpiece material. If the workpiece material hardens too fast and/or the shape change is too complex, the workpiece can crack during the deep-drawing operation.

As cooling liquid for example water is suitable. With the method according to invention the deformation process can be improved by addition of a lubricant into the liquid bath. As lubricant for example graphite or a graphite-free water-miscible die lubricant can be used, which is currently already used for forged parts. With the lubricant the deformation of the workpiece is supported and die wear is reduced.

In a special embodiment the lower die of the press is only partially immersed in the liquid bath. Parts of the die face lie above the liquid level. Possibly, the workpiece to be shaped can be placed directly on the parts of the die face protruding out of the liquid. During the deep drawing operation liquid portions situated within the recesses of the die face are displaced, so that the workpiece comes into contact with the liquid almost completely through a displacement process.

The method according to invention is especially is suitable for deep drawing and hardening of a workpiece material, which in weight percent is comprised of:

| | |
|---|---|
| Carbon (C) | 0.18% to 0.3%, |
| Silicon (Si) | 0.1% to 0.7%, |
| Manganese (Mn) | 1.0% to 2.5%, |
| Phosphorous (P) | 0 to 0.025%, |
| Chrome (Cr) | 0 to 0.8%, |
| Molybdenum (Mo) | 0 to 0.5%, |
| Sulphur (S) | 0 to 0.01%, |
| Titanium (Ti) | 0.02% to 0.05%, |
| Boron (B) | 0.0015% to 0.005%, and |
| Aluminum (Al) | 0.01% to 0.06%. |

The balance is iron including melt-based impurities. This workpiece material can be hardened well in a liquid and has after hot shaping and hardening a stretching limit $R_{P0.2} \geqq 950$ MPa, a tensile strength $R_m \geqq 1350$ MPa and an elongation $A5 \geqq 6\%$. Especially, it hardens also in a liquid slowly enough to deep draw it during the hardening operation.

Experiments have shown that a workpiece from the above-mentioned material heated to about 950° C. with the method according to invention with a holding time in the bottom dead center of the press of less than 1 second has a hardness of above 500 HV30 and could be shaped sufficiently. If the hardness exceeds the required demanded limit, it can be reduced with a subsequent heating process to a desired lower level. Finally the hardness and residual elongation can be adjusted also with the temperature of the workpiece at the beginning of the method according to invention. It is decisive, that the deformation and hardening method according to invention can be operated with a higher cycle rate than up to now.

A press according to invention for carrying out the method features has a lower die sitting in a liquid bath so that its upper normally contoured, that is nonplanar, face is at least partially below the liquid level of the bath. The upper die is both movable above and below the liquid, so that a workpiece in the opened state of the press can be placed above the liquid level. At least the lower die has not have to have inner cooling passages, recesses or the like. Depending on the press configuration this also applies to the upper die. Because of the lack of sensitive and expensive cooling passages, the dies are relatively maintenance free. Moreover, the dies can be produced more easily and cheaply since the laborious process of drilling out the cooling passage is eliminated. Due to the lack of cooling passages there is no weakening of the die. Depending on the die-face shape it can be necessary to drill drain holes in the lower dies so that liquid can run off, if the lower die face is shaped such that coolant liquid can pool in it. The press is provided as necessary with known elements such as hold downs, guide rods, stoppers, ejectors and so on. Hence, the loading and unloading of the press with workpieces is easy. The cycle rate with which hardened, accurately dimensioned workpieces can be produced is relatively high.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
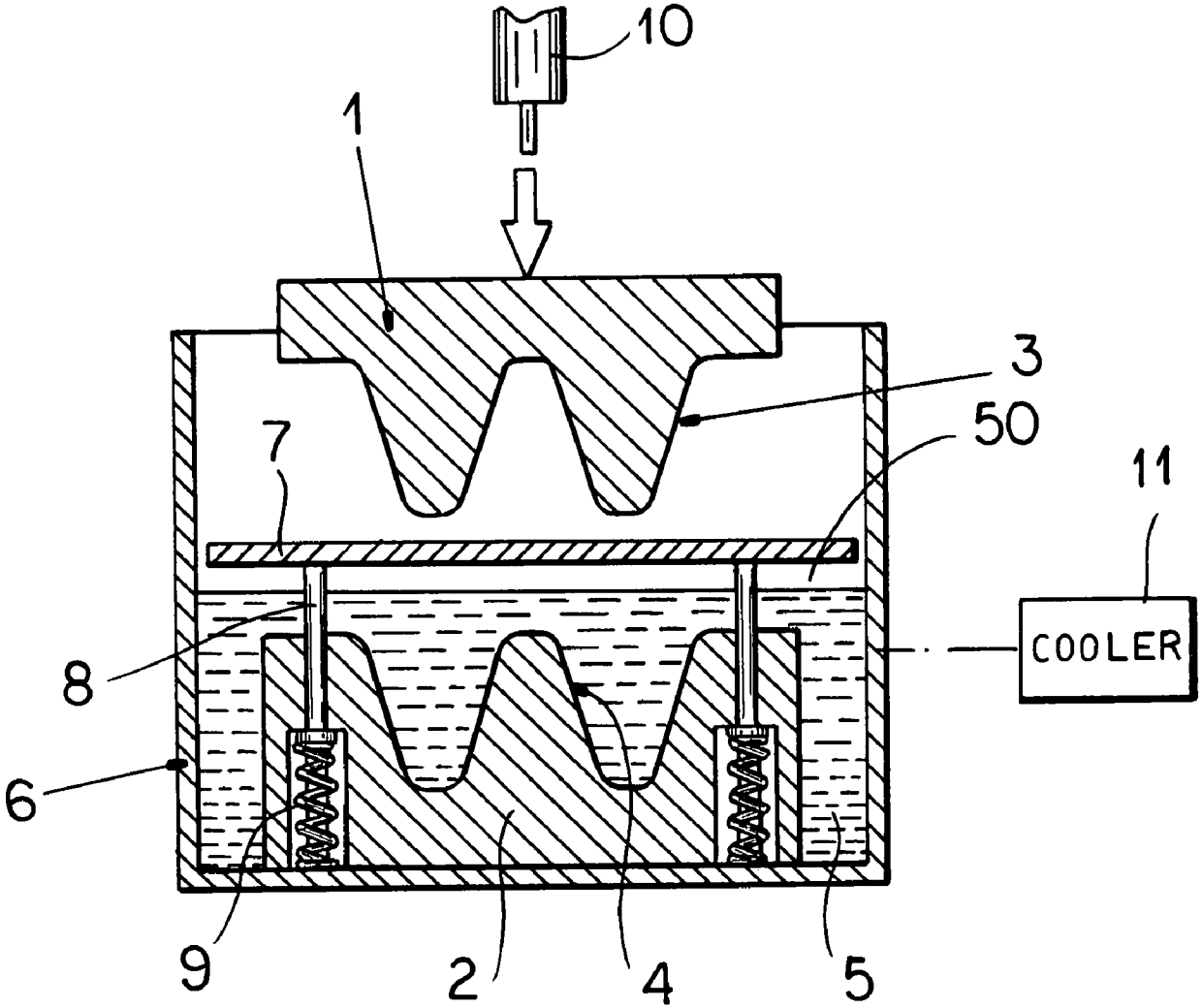
FIG. 1 is a partly schematic section through a press according to the invention.

As seen in FIG. 1 a press has two dies 1 and 2 having faces 3 and 4. The lower die 2 is fixed in a vessel 6 holding a bath 5 or a suitable cooling and/or lubricating liquid so that the lover die face 4 is totally below the liquid level 50. A cooler 11 maintains the bath 5 at a desired quenching temperature. An austenitized plate workpiece 7 lies above the liquid level 50 on a special means for positioning or supports 8 that are supported on resilient elements, here springs 9 sufficiently stiff that they hold in the illustrated up position even when pushed down with a moderate amount of force. Advance of the upper die 1 downward by a means for moving or actuator shown schematically at 10 presses a plate 7 positioned between the faces 3 and 4 downward into the bath 5 and against the lower face 4. Immediately a hardening of the plate 7 is initiated. The supports 8 are pressed downward into the lower die 2 against the force of the springs 9 until both dies 1 and 2 are closed and the workpiece 7 is shaped and hardened. The workpiece 7 can be taken out almost immediately and will be relatively cool, accurately dimensioned, and suitably hardened. With adjustment of the processing parameters with respect to the hardening rate and the conditions of the deep-drawing operation the press can work automatically. This accelerates the total process and makes possible, if desired, the use of mechanical presses.

Figure 2:
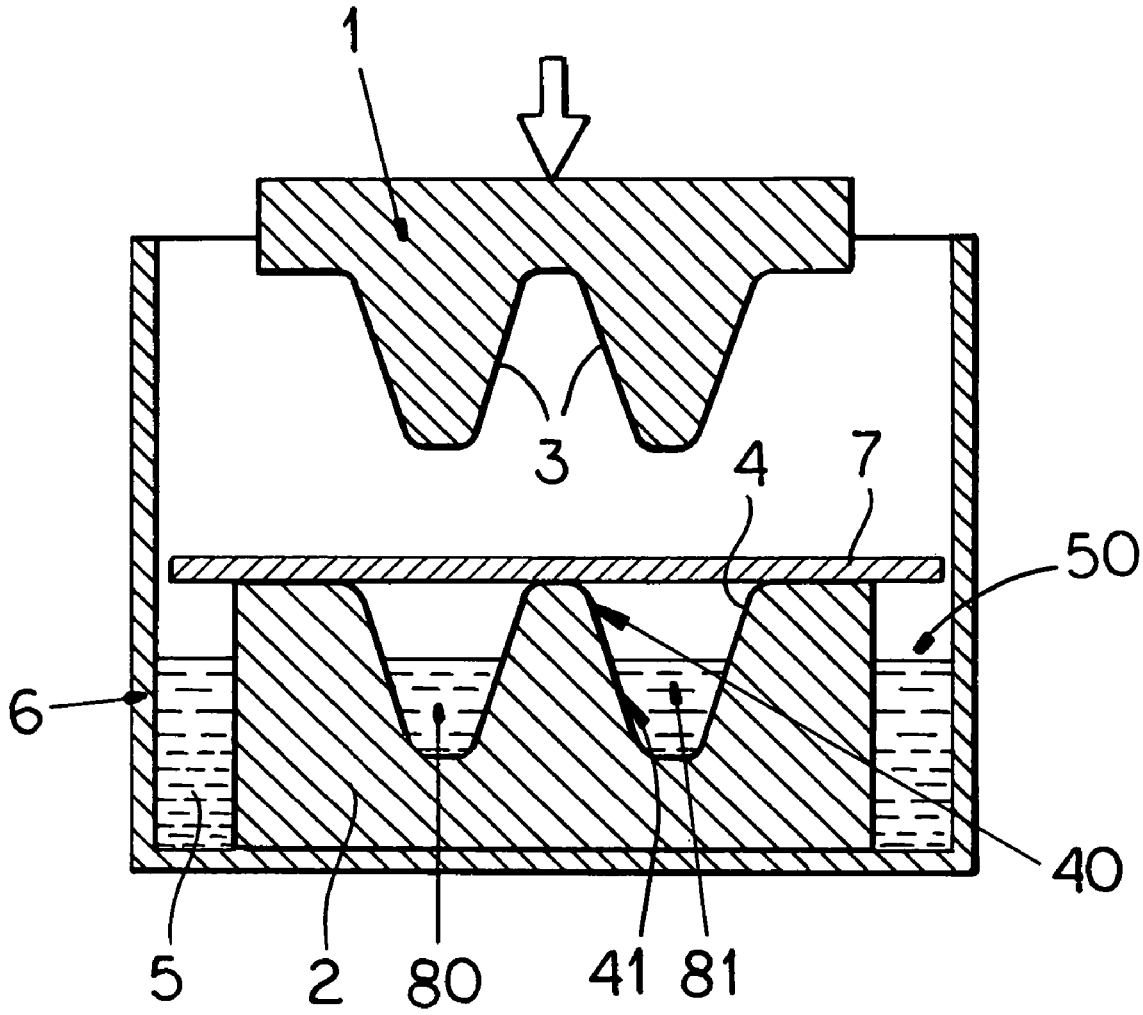
FIG. 2 is a view like FIG. 1 of another press according to the invention.

In FIG. 2 the face 4 of the lower die 2 is only partially below the level 50 of the liquid bath 5. Parts 41 lie below the liquid level 50 and other parts 40 lie above the liquid level 50. The plate 7 lies directly on the lower die 2, so that to start with it is out of with the liquid of the bath 5. Downward shifting of the upper die 1 pushes the plate 7 into recesses 80 and 81 of the face 4 of the lower die. This causes the liquid 5 in the recesses 80 and 81 to be displaced upward so that the plate 7 comes into contact with the liquid of the bath 5 at the hitherto dry parts 40 of the face 4. With this special press assembly locally varying hardness and/or deformation levels can be achieved. The assembly itself depends on the workpiece geometry and the hardness values that are wanted.

Figure 3:
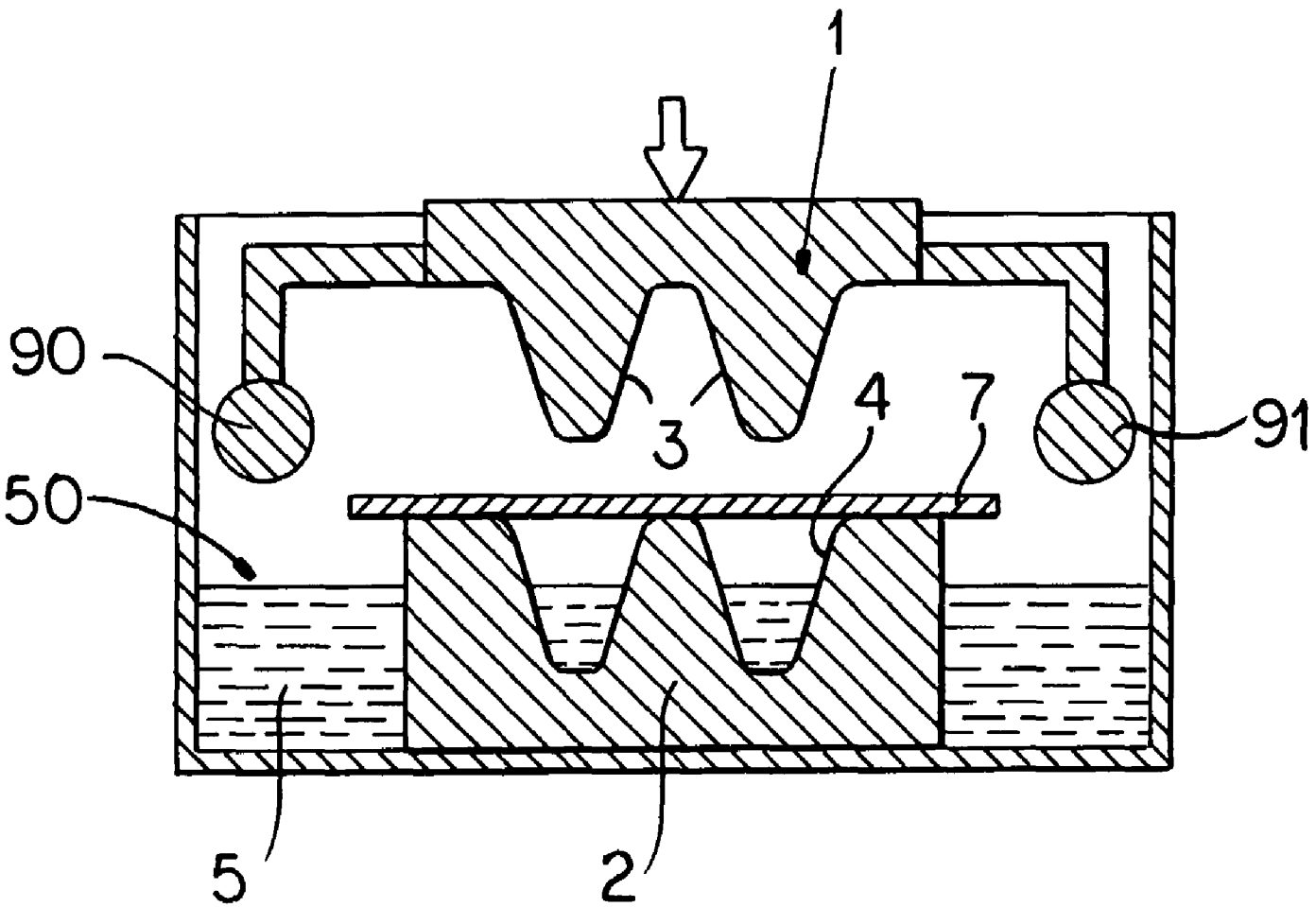
FIG. 3 is yet another view like FIG. 1 of a third press in accordance with the invention.

In FIG. 3 the press from FIG. 2 is additionally equipped with displacement elements 90 and 91. The displacement elements 90 and 91 are arranged outside of the actual shaping die 1 and are shaped as relatively massive elements lying at a level with the lowermost portions of the face 3 of the upper die 1. Downward advance of the upper die 1 toward the lower die 2 causes the displacement elements 90 and 91 to be re immersed in the liquid bath 5 laterally to each side of the workpiece 7 to be shaped. The liquid of the bath 5 is displaced by the elements 90 and 91 so that the level 50 rises upward toward the upper die 1. Depending on the height of the liquid level 50 to start with the volume of the bodies 90 and 91, the liquid 5 floods the faces 3 and 4 of the dies 1 and 2 and the workpiece 7. The displacement bodies 90 and 91 thus control the liquid level 50 so that the workpiece 7 comes into sufficient contact with the liquid 5 to achieve the desired hardness values and deformation levels.

We claim:

1. A press for hot-shaping and hardening a hot steel workpiece that is at or above its AC3 temperature, the press comprising:

a movable upper die and a stationary lower die having lower and upper confronting faces;

means for positioning the hot workpiece between the confronting faces of the dies;

a coolant bath at a temperature below the workpiece AC3 temperature and having a liquid level wholly above the face of the lower die; and means for moving the upper die from an upper position wholly above the bath toward the lower die and into a lower position at least partially immersed in the bath and thereby pressing the hot workpiece with the upper die down against the lower die and deforming the workpiece so that it conforms to the shapes of the faces and that it is at least partially immersed in the bath.

2. The shaping and hardening press defined in claim 1, wherein the bath includes a lubricant.

3. The shaping and hardening press defined in claim 1, wherein the one die is reciprocated continuously by the means for moving.

4. The shaping and hardening press defined in claim 1, wherein the press is mechanical.

5. A press for hot-shaping and hardening a hot steel workpiece that is at or above its AC3 temperature, the press comprising:

a stationary lower die having an upper face;

an upper die having a lower face confronting the upper face and the upper die is movable above the lower die between an upper portion and a lower position;

means for positioning the hot workpiece between the confronting faces of the dies;

a coolant bath at a temperature below the workpiece AC3 temperature and having a liquid level above all of the upper face of the lower die, below all of the lower face of the upper die in the upper position of the upper die, and above at least part of the lower face of the upper die in the lower position of the upper die;

means for moving the upper die vertically downward toward the lower die and thereby pressing the hot workpiece with the upper die down against the lower die and both deforming the workpiece so that it conforms to the shapes of the faces and that it is at least partially immersed in the bath; and a liquid-displacement element carried on the upper die and immersible in a lower position thereof in the bath to raise the liquid level thereof, whereby as the upper die moves downward it pushes the element into the bath and raises the liquid level.

6. The shaping and hardening press defined in claim 5, wherein the coolant bath only covers a portion of the face of the lower die and another portion of the face of the lower die is above the liquid level.

* * * * *